United States Patent [19]

Kim

[11] Patent Number: 4,587,510

[45] Date of Patent: May 6, 1986

[54] ANALOG JOYSTICK CONTROLLER

[75] Inventor: Syng N. Kim, Hoffman Estates, Ill.

[73] Assignee: Wico Corporation, Niles, Ill.

[21] Appl. No.: 543,469

[22] Filed: Oct. 19, 1983

[51] Int. Cl.[4] ..... H01C 10/16

[52] U.S. Cl. ..... 338/128; 338/129; 74/471 XY

[58] Field of Search ..... 338/128, 129; 74/471 XY; 200/6 A; 273/148 B, DIG. 28

[56] References Cited

U.S. PATENT DOCUMENTS

| | | | |
|---|---|---|---|
| 3,020,457 | 2/1962 | Kelley | 318/16 |
| 3,095,754 | 7/1963 | Mayou et al. | 74/471 XY |
| 3,308,675 | 3/1967 | Jonsson | 74/471 XY |
| 3,376,575 | 4/1968 | Peters | 318/16 |
| 3,394,611 | 7/1968 | Beurier | 74/471 XY |
| 3,760,320 | 9/1973 | Oka et al. | 338/128 |
| 3,870,161 | 3/1975 | Cording | 74/471 XY |
| 3,870,986 | 3/1975 | Oka et al. | 338/128 |
| 3,918,021 | 11/1975 | Nishioka et al. | 338/128 X |
| 3,939,451 | 2/1976 | Kasahima | 338/128 X |
| 3,942,148 | 3/1976 | Nishioka | 338/128 X |
| 4,042,902 | 8/1977 | Meyer et al. | 338/128 |
| 4,093,953 | 6/1978 | Hammons et al. | 74/471 XY X |
| 4,101,863 | 7/1978 | Lewicki | 338/128 |
| 4,161,726 | 7/1979 | Burson et al. | 338/128 X |
| 4,275,611 | 6/1981 | Asher | 74/471 XY |
| 4,325,050 | 4/1982 | Suszynski | 338/128 |
| 4,489,304 | 12/1984 | Hayes | 338/128 |
| 4,490,710 | 12/1984 | Kopsho, Jr. et al. | 338/128 |

FOREIGN PATENT DOCUMENTS

| | | | |
|---|---|---|---|
| 1540096 | 2/1979 | United Kingdom | 338/128 |

*Primary Examiner*—C. L. Albritton
*Assistant Examiner*—M. M. Lateef
*Attorney, Agent, or Firm*—Emrich & Dithmar

[57] ABSTRACT

An analog joystick controller includes a handle shaft engageable with two yokes rotatably movable respectively about two perpendicular axes in response to tilting of the handle shaft. The yokes are respectively coupled to the wipers of two potentiometers, the resistance portions of which are fixedly connected to adjusting means manually movable for zero adjustments. Each yoke carries a pair of pivoting levers biased together into engagement with the yoke for movement therewith. Each pair of levers is associated with a control block which is manually movable between the levers to permit only one of them to move when the handle is moved from a center or home position, depending upon the direction of movement of the handle, for biasing the handle to its center position.

21 Claims, 14 Drawing Figures

20
91
21
4
45
3
75
65
4
30

40
41
43
59
70
42
50
71
73
51
52
48
110
88
108
111
140
112
143
131
157
55
53
54
139
133
63
170
44
156
149
130
60
155
80
61
57
48
88
88
48
172
82
44
170
171
81
80

45
120
122
103
46
100
101
147
102
40
5
5
105
106
115
145
146
42
117
121
113
112
43
144
33
178
149
142
177
124
123
143
32
176
35
30
31

91
90
92
93
94
99
75
65
41
54
95
137
81
51
42
135
44
48
136
55
38
67
134
132
139
178
32
62
63
39
133
177
34
30
31
96
36
176

ANALOG JOYSTICK CONTROLLER

BACKGROUND OF THE INVENTION

The present invention relates to a joystick controller for electric switches, of the type which is used for controlling the operation of certain electronic games and the like. In particular, this invention relates to an analog joystick controller, i.e., a controller of the type which produces an output signal which varies continuously with the movement of the handle shaft.

In a typical analog joystick controller, the handle shaft is mechanically coupled to the wipers of two potentiometers, so that tilting movement of the handle along two perpendicular axes respectively varies the impedance of the two potentiometers. Prior analog joystick controllers have provided zero adjustment means for moving the resistance portion of each potentiometer with respect to its wiper to adjust the potentiometer to a zero impedance value corresponding with a predetermined home position of the handle, typically a centered position. These zero adjustment mechanisms have involved compound linkages between the potentiometer and a manual actuator, the linkage comprising plural parts resulting in a complex structure which is difficult to assemble and expensive to manufacture.

Prior analog joystick controllers have also provided means for selectively operating the controller in either one of two operating modes, viz., a positive positioning mode, wherein wherever the joystick handle is moved it maintains that position until it is manually moved again by the user, and a self-centering mode, wherein the joystick handle is biased to a center home position. The bias means are typically tension springs and the prior selection means is operated in such a way that when the positive positioning mode is selected, the springs are held in a maximum tension position. This places undue stress on the bias springs and results in their loss of elasticity and possible failure.

SUMMARY OF THE INVENTION

It is a general object of the present invention to provide an improved analog joystick controller which avoids the disadvantages of prior controllers while affording additional structural and operating advantages.

An important object of this invention is the provision of an analog joystick controller which provides a zero adjustment mechanism which is of simple and economical construction.

Still another object of this invention is the provision of an analog joystick controller which permits selection between positive positioning and self-centering operating modes without undue wear and strain on the centering bias means.

These and other objects of the invention are attained by providing an analog joystick controller including a housing and an operating shaft mounted in the housing for universal tilting movement with respect thereto between a neutral or home position and operating positions, the improvement comprising: bias means coupled to the operating shaft and shiftable between first and second operating conditions, the bias means in the first operating condition thereof being responsive to movement of the operating shaft from its home position for increasing the potential energy of the bias means to bias the operating shaft to its neutral or home position, the bias means in the second operating condition thereof storing minimal potential energy and being unresponsive to movement of the operating shaft for accommodating free unbiased tilting movement of the operating shaft, and actuating means for selectively disposing the bias means in either the first or the second operating condition thereof.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
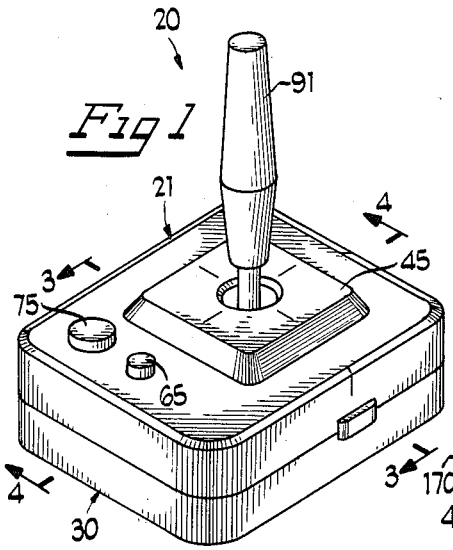
FIG. 1 is a perspective view of an analog joystick controller constructed in accordance with and embodying the features of the present invention.
Figure 14:
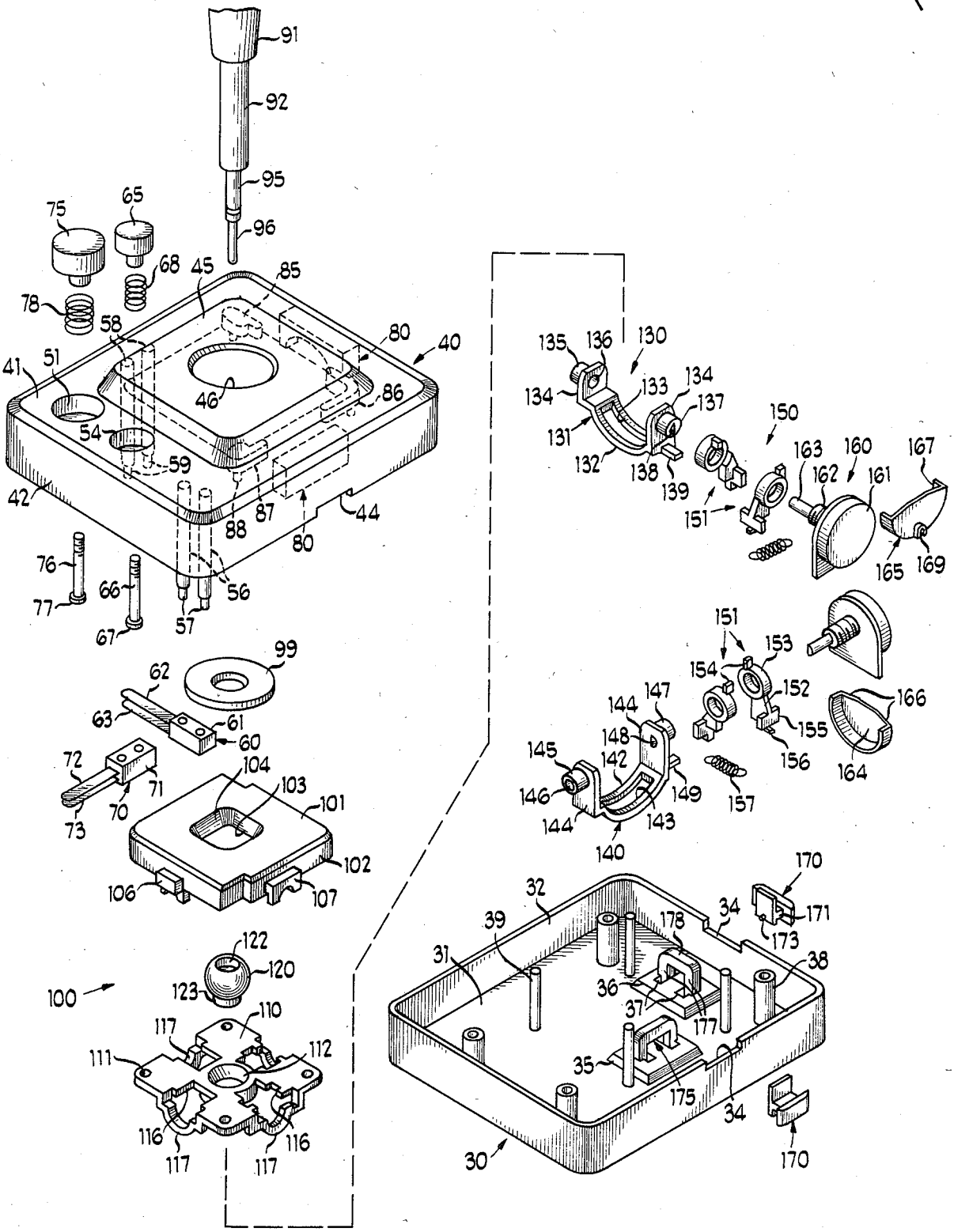
FIG. 14 is an exploded perspective view of the joystick controller of FIG. 1.

Referring to FIGS. 1 and 14, there is illustrated an analog joystick controller, generally designated by the numeral 20, constructed in accordance with and embodying the features of the present invention. The joystick controller 20 includes a two-part outer casing or enclosure 21, including a bottom or base 30 and a cover or top 40 which are fitted together to form a closed casing.

Figure 2:
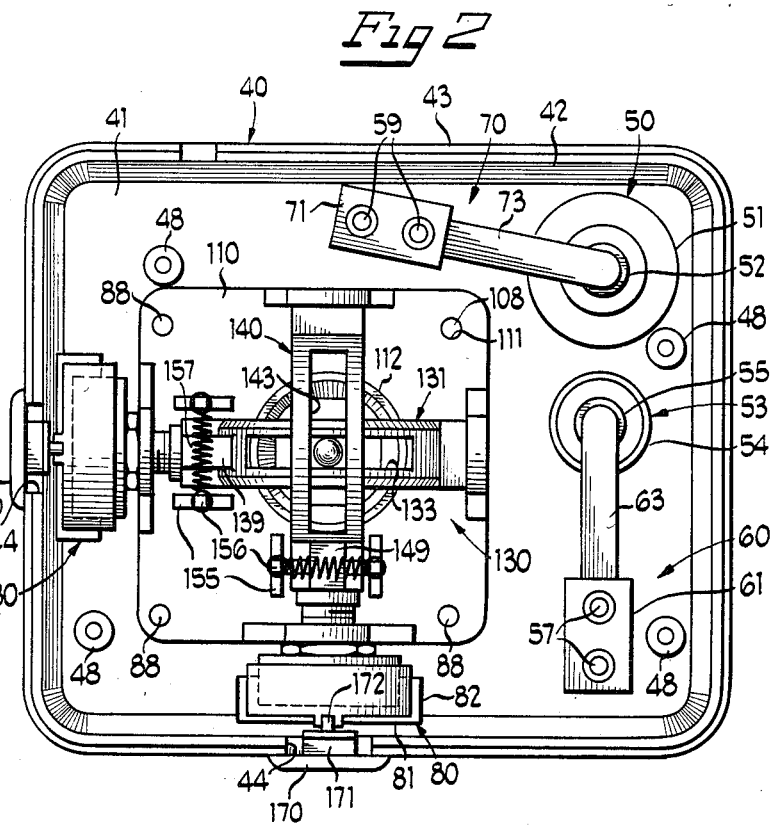
FIG. 2 is an enlarged bottom plan view of the cover portion of the joystick controller of FIG. 1, with the base portion removed and with the handle disposed in its center position.
Figure 3:
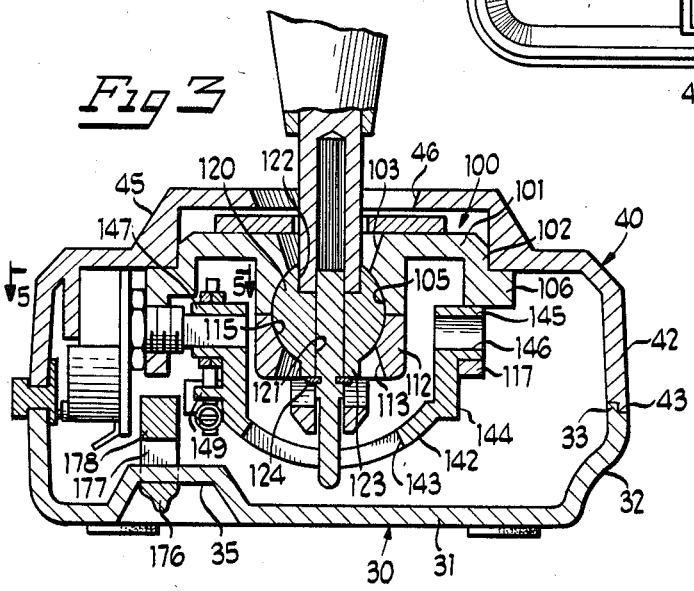
FIG. 3 is an enlarged fragmentary view in vertical section taken along the line 3—3 in FIG. 1.
Figure 4:
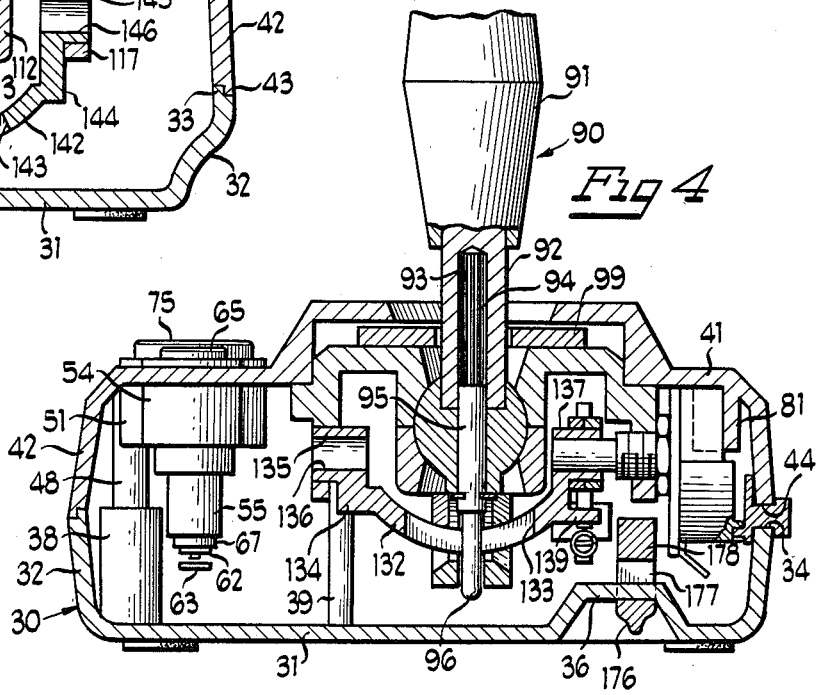
FIG. 4 is an enlarged fragmentary view in vertical section taken along the line 4—4 in FIG. 1.

Referring also to FIGS. 2 through 4 of the drawings, the base 30 is an open-top generally rectangular structure including a bottom wall 31 integral around the perimeter thereof with an upstanding peripheral side wall 32. The side wall 32 is provided along its upper edge with a reduced-thickness peripheral lip 33. Formed in the upper edge of the side wall 32, respectively centrally of two adjacent sides thereof, are two shallow rectangular notches 34. Formed in the bottom wall 31, respectively adjacent to the notches 34, are two recessed portions 35 and 36, each having a pair of spaced-apart rectangular apertures 37 therethrough (see FIGS. 7 and 8). Integral with the bottom wall 31 and projecting upwardly therefrom are four attachment tubes 38, each communicating with a corresponding opening in the bottom wall 31. Also integral with the bottom wall 31 and extending upwardly therefrom are four retaining pins 39.

The cover 40 is an open-bottom generally rectangular structure including a generally rectangular top wall 41, integral around the perimeter thereof with a depending peripheral skirt 42. The skirt 42 is provided along its lower edge with a reduced-thickness portion forming a peripheral lip 43. Formed in the lower edge of the skirt 42, respectively centrally of two adjacent sides thereof, are two shallow rectangular notches 44. The cover 40 is dimensioned for mating engagement with the base 30, the lips 33 and 43 interfitting, as indicated in FIGS. 3 and 4, and the notches 34 respectively aligning with the notches 44 to define rectangular openings through the side of the casing 21. The cover 40 has a raised generally rectangular turret portion 45 on the top wall 41, the turret portion 45 having a circular aperture 46 therethrough. Integral with the inner surface of the top wall 41 and depending therefrom are four cylindrical lugs 48 (FIGS. 2 and 4) which respectively align with the attachment tubes 38 for receiving complementary screws (not shown) securely to hold the base 30 and the cover 40 together in the assembled condition illustrated in FIG. 1.

Integral with the top wall 41 adjacent to a corner thereof and depending therefrom is a cylindrical push button housing, generally designated by the numeral 50. The push button housing 50 includes a relatively large-diameter cup 51, having a circular opening in the bottom thereof which communicates with a cylindrical tube 52 (FIG. 2) integral with the cup 51 and depending therefrom. Also integral with the top wall 41 adjacent to the push button housing 50 is a smaller push button housing 53, which also includes a depending cup 54, having a central opening in its bottom which communicates with a cylindrical tube 55 integral with the cup 54 and depending therefrom. Also integral with the inner surface of the top wall 41 and depending therefrom are a pair of mounting pins 56, each having a reduced-diameter tip 57, and a pair of mounting pins 58, each having a reduced-diameter tip 59.

Associated with the push button housing 53 is a switch assembly 60, which is preferably a leaf switch including a rectangular body 61 having two leaf spring contacts 62 and 63. The body 61 has two bores therethrough for respectively receiving the tips 57 of the mounting pins 56 to mount the switch assembly 60 in an assembled position, with the contact 62 extending beneath the lower end of the tube 55. A push button 65 is disposed in the cup 54 and is fixedly secured to a shaft 66 which extends downwardly through the tube 55 (see FIG. 14) and is attached at its lower end to an actuator pad 67 disposed for engagement with the switch contact 62. A helical compression spring 68 is disposed in the cup 54 for biasing the push button 65 to a normal rest position wherein it projects a predetermined distance above the top wall 41 for access by a user. Depression of the push button 65 closes the switch contacts 62 and 63 for actuation of the switch assembly 60 in a known manner.

Associated with the push button housing 50 is a leaf switch assembly 70 which includes a body 71 provided with leaf spring contacts 72 and 73 (see FIGS. 2 and 14). The body 71 has bores therethrough for respectively receiving the tips 59 of the mounting pins 58 for mounting the switch assembly 70 with the contact 72 thereof disposed beneath the lower end of the tube 52. A push button 75 is disposed in the cup 51 and is fixedly secured to a shaft 76 (FIG. 14) which extends downwardly through the tube 52 and is attached at its lower end to an actuator pad 77 disposed for engagement with the switch contact 72. A helical compression spring 78 is disposed in the cup 51 for resiliently biasing the push button 75 to a normal rest position projecting a predetermined distance above the top wall 41 for access by a user, depression of the push button 75 actuating the switch assembly 70.

Figure 6:
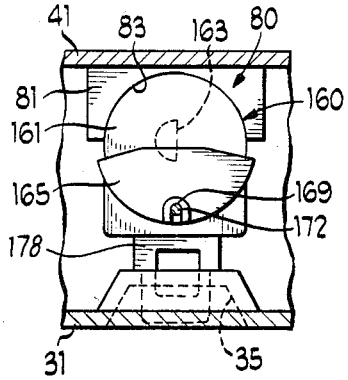
FIG. 6 is a fragmentary view in vertical section taken along the line 6—6 in FIG. 5.

Also integral with the top wall 41 and depending therefrom along the skirt 42, respectively adjacent to the notches 44, are two receptacle blocks 80, each having an outer wall 81 and a pair of side walls 82 cooperating to define a recess having an arcuate inner surface 83 (FIG. 6). Also integral with the top wall 41 and depending therefrom respectively adjacent to three of the corners of the turret portion 45 are three positioning blocks 85, 86 and 87, each provided with a depending positioning pin 88 (see FIG. 14).

The joystick controller 20 includes a handle assembly, generally designated by the numeral 90, including an elongated handle 91 having a cylindrical extension 92 (FIG. 4) provided with an axial bore 93 in the distal end thereof for frictionally receiving therein the knurled end 94 of an elongated operating shaft 95. The shaft 95 is provided with a reduced-diameter tip 96 at its distal end.

The handle assembly 90 is mounted for universal tilting movement in a ball and socket assembly 100, which includes a top plate 101 seated in the turret portion 45 and centered therein by the positioning blocks 85–87, and a freely sliding washer 99 being provided above the top plate 101 in the turret portion 45 around the handle extension 92. Integral with the top plate 101 around the perimeter thereof and depending therefrom is a peripheral wall 102. Formed centrally in the top plate 101 is a rectangular aperture 103 having an outwardly beveled upper portion 104 (FIG. 14) and a part-spherical inner or lower portion 105 (FIG. 3). Integral with the peripheral wall 102 and projecting laterally outwardly therefrom respectively along the four sides thereof are two retaining lugs 106 and two bearing blocks 107, each of the lugs 106 and blocks 107 being disposed for engagement with the top wall 41 thereby to limit the depth of insertion of the top plate 101 into the turret portion 45. A locating pin 108 (FIG. 2) depends from the peripheral wall 102 adjacent to one corner thereof.

Figure 11:
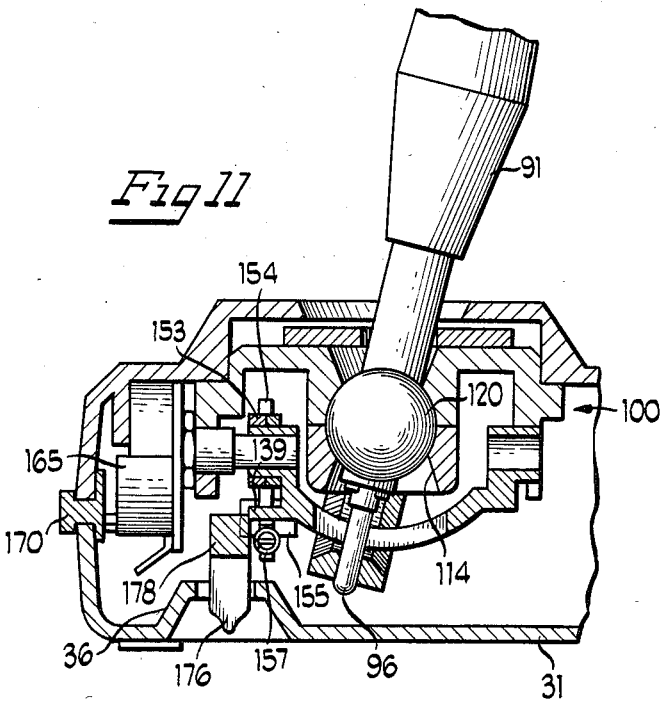
FIG. 11 is a fragmentary view in vertical section taken along the line 11—11 in FIG. 10.

The ball and socket assembly 100 also includes a base plate 110 having four locating holes 111 respectively disposed at the four corners thereof and having a cylinder 112 depending therefrom centrally thereof and defining a circular aperture 113 through the base plate 110. The aperture 113 has an outwardly beveled outer or lower portion 114 (see FIG. 11) and a part-spherical upper or inner portion 115 (FIG. 3). Four irregular notches 116 are formed, respectively, in the four sides of the base plate 110 centrally thereof (FIG. 14), the notches 116 being respectively spanned at their outer ends by four arcuate bearing blocks 117 depending from the base plate 110 integral therewith.

In use, the base plate 110 is mated with the top plate 101, being disposed against the lower edge of the peripheral wall 102, with the locating pin 108 being disposed in one of the locating holes 111 and with the positioning pins 88 being respectively disposed in the other three of the locating holes 111. When thus assembled, the part-spherical portions 105 and 115 of the apertures 103 and 113 cooperate to form a socket or seat in which is trapped a ball 120 having a cylindrical bore 121 extending diametrically therethrough. The bore 121 has an enlarged-diameter recess 122 at one end thereof which communicates with the beveled outer part 104 of the aperture 103. At the other end of the bore 121, the ball 120 is provided with a cylindrical extension 123 which extends downwardly through the beveled outer portion 114 of the aperture 113 to a point substantially flush with the lower end of the cylinder 112. The ball 120 is dimensioned for free rotational movement in the socket formed by the top plate 101 and the base plate 110 and for receiving the shaft 95 through the bore 121, with the handle extension 92 being seated in the recess 122. The shaft 95 is held in place in the ball 120 by a retaining clip 124 (FIG. 3) which engages the lower end of the cylindrical extension 123. Thus, the ball and socket assembly 100 accommodates a free universal tilting movement of the handle assembly 90. When the base 30 and the cover 40 are assembled together, the retaining pins 39 on the base 30 engage the base plate 110, securely to hold the ball and socket assembly 100 in position in its assembled condition.

The joystick controller 20 also includes a control assembly 130 which includes inner and outer yokes 131 and 140 which extend substantially perpendicular to each other. The inner yoke 131 includes an arcuate bow 132 having an elongated rectangular slot 133 therethrough extending longitudinally thereof. Respectively integral with the bow 132 at its opposite ends are two upstanding ears 134. Integral with one of the ears 134 and extending laterally outwardly therefrom is a cylindrical bushing 135 having a cylindrical bore 136 extending axially therethrough. Integral with the other ear 134 is a bushing 137 which extends laterally outwardly therefrom and has a part-cylindrical bore 138 extending therethrough. The bushings 135 and 137 are arranged coaxially with each other. Integral with one of the ears 134 and projecting laterally therefrom immediately beneath the bushing 137 is a short rectangular lug 139.

Figure 7:
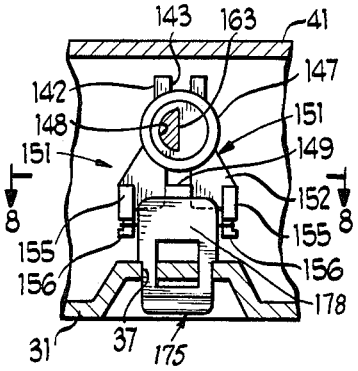
FIG. 7 is a fragmentary view in vertical section taken along the line 7—7 in FIG. 5.
Figure 8:
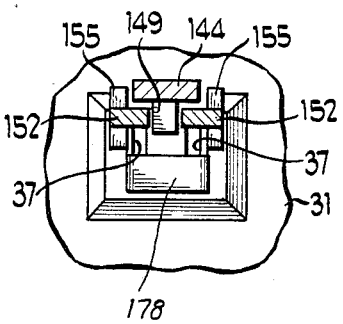
FIG. 8 is a fragmentary view in horizontal section taken along the line 8—8 in FIG. 7.
Figure 9:
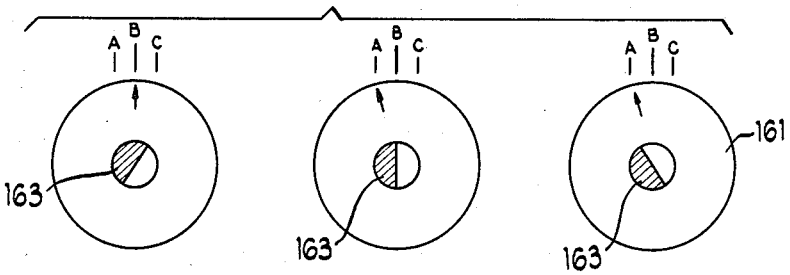
FIG. 9 is a diagrammatic view illustrating the operation of the zero adjust mechanism of the present invention.
Figure 10:
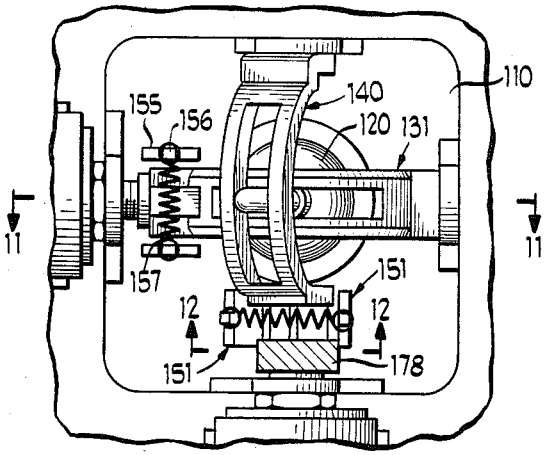
FIG. 10 is a fragmentary view similar to FIG. 2, of the central portion thereof, illustrating the mechanism with the handle moved from its center position.
Figure 12:
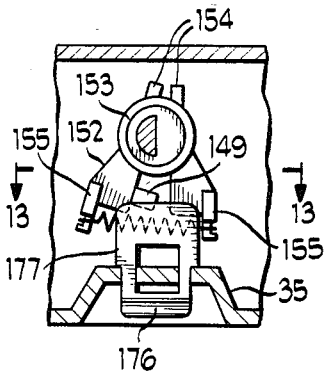
FIG. 12 is a fragmentary view in vertical section taken along the line 12—12 in FIG. 10.
Figure 13:
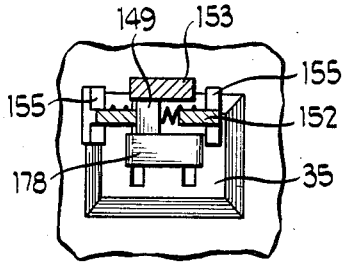
FIG. 13 is a fragmentary view in horizontal section taken along the line 13—13 in FIG. 12.

The outer yoke 140 also has an arcuate bow 142 provided with an elongated rectangular slot 143 therethrough extending longitudinally thereof. The bow 142 is integral at its opposite ends, respectively, with two upstanding ears 144. Integral with one of the ears 144 and extending outwardly therefrom is a bushing 145 having a cylindrical bore 146 extending axially therethrough. Integral with the other ear 144 and extending outwardly therefrom coaxially with the bushing 145 is a bushing 147 having a part-cylindrical bore 148 extending therethrough (FIGS. 7 and 14). Integral with the latter ear 144 and extending outwardly therefrom immediately beneath the bushing 147 is a short rectangular lug 149 (FIGS. 3, 7, 8 and 14).

Figure 5:
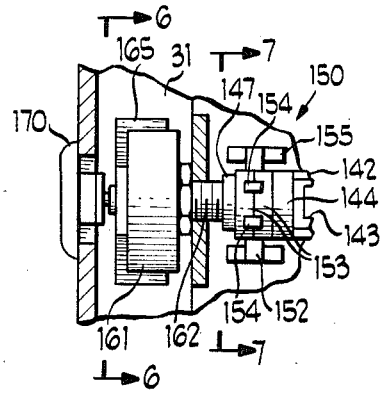
FIG. 5 is a fragmentary view in horizontal section taken along the line 5—5 in FIG. 3.

Referring now also to FIGS. 5–8 of the drawings, each of the yokes 131 and 140 is provided with a lever assembly 150, the two lever assemblies 150 being substantially identical in construction, so that only one will be described in detail. Each lever assembly 150 includes a pair of levers 151, each having a flat arm 152 provided at one end thereof with a cylindrical bushing 153 having a stop finger 154 projecting upwardly therefrom (FIGS. 5 and 14). Integral with the arm 152 at the other end thereof and extending therefrom substantially perpendicular thereto is a rectangular control block 155 having a lug 156 depending therefrom centrally thereof.

In use, the two levers 151 are adapted to be mounted on the corresponding one of the yokes 131 or 140 and, more specifically, on the bushing 137 or 147 thereof. Referring to the yoke 131, by way of example, the levers 151 are arranged with their bushings 153 coaxially abutting each other and fitted over the bushing 137 for rotational movement about the axis thereof. The levers 151 are oriented so that the depending arms 152 thereof are respectively disposed in engagement with opposite sides of the lug 139, in which position the stop fingers 154 are disposed for engagement with each other. The lugs 156 are interconnected by a helical tension spring 157 which holds the levers 151 resiliently in a normal rest position, just described. The other lever assembly 150 is mounted on the bushing 147 of the outer yoke 140, in the same manner, so that the bow 142 crosses over the bow 132 with the axes of the bows 132 and 142 disposed substantially perpendicular to each other. The tip 96 of the shaft 95 extends through both of the overlapped slots 133 and 143 for engagement with both of the bows 132 and 142 (FIGS. 2–4, 10 and 11).

The joystick controller 20 also includes two potentiometers 160, respectively mounted in the two receptacle blocks 80. The potentiometers 160 are substantially identical, each including a cylindrical body 161 which houses the resistive portion of the potentiometer, and a wiper rotor 162, mounted for coaxial rotation with respect to the body 161. The distal end of the rotor 162 is cut away to form a part-cylindrical key 163. The body 161 is received in the associated one of the receptacle blocks 80, in engagement with the arcuate inner surface 83, the depth of the surface 83 being such that approximately half of the body 161 extends outwardly beyond the distal edge of the receptacle block 80. When the potentiometer 160 is thus mounted, its rotor 162 extends laterally inwardly of the casing 21. It will be appreciated that when the top plate 101 and base plate 110 of the ball and socket assembly 100 are assembled together, the bearing blocks 107 respectively cooperate with the bearing blocks 117 to form two pairs of cylindrical bearings, with the pairs being aligned along perpendicular axes. The rotor 162 of one potentiometer 160 extends through one bearing of one of these pairs, while the rotor 162 of the other potentiometer 160 extends through one bearing of the other pair of bearings. The key 163 of one of the potentiometers 160 is fitted in the part-cylindrical bore 138 in the bushing 137 of the inner yoke 131. The bushing 135 of the inner yoke 131 is rotatably received in the other bearing of that pair (see FIG. 4). Similarly, the key 163 of the other potentiometer 160 is fitted in the part-cylindrical bore 148 of the bushing 147 of the outer yoke 140. The bushing 145 of the outer yoke 140 is rotatably received in the other bearing of that pair (see FIG. 3). Thus, it will be appreciated that rotation of the yokes 131 and 140 by tilting movement of the handle assembly 90 effects corresponding rotation of the rotors 162 of the potentiometers 160 for generating signals proportional to the degree of movement along each axis.

Each of the potentiometers 160 is provided with an adjustment sheath 165 which includes a generally semicircular end 164 integral around the arcuate portion of its perimeter with a part-cylindrical side wall 167 extending therefrom substantially perpendicular thereto (FIG. 14). Thus, the adjustment sheath 165 is generally in the form of a half cup dimensioned to fit over the portion of the potentiometer body 161 which projects beyond the receptacle block 80, with the end wall 164 disposed parallel to and facing the skirt 42 of the cover 40. The adjustment sheath 165 is fixedly secured to the potentiometer body 161, as by adhesive bonding. The non-arcuate edge of the end wall 164 is provided with two inclined stop surfaces 166. Integral with the end wall 164 and projecting laterally outwardly therefrom midway between the ends of the side wall 167 is a part-cylindrical sleeve 169 (FIGS. 6 and 14).

The joystick controller 20 is also provided with two actuators 170, respectively disposed adjacent to the openings in the casing 21 formed by the mating notches 34 and 44. Each actuator 170 is in the form of a rectangular plate which spans the associated casing aperture along the outer surface of the casing 21. The actuator 170 has an integral slider tab 171 which projects therefrom normal thereto through the associated aperture in the casing 21, the slider tab 171 being provided at its distal end with a pin 172 which fits into the sleeve 169 on the associated adjustment sheath 165 (see FIGS. 4, 5 and 14). Thus, as the actuator 170 is slid horizontally along the casing 21, the adjustment sheath 165 and the associated potentiometer body 161 are rotated about the axis of the rotor 162, thereby permitting a zero adjustment of the potentiometer 160. The rotation of the potentiometer body 161 is limited by engagement of the stop surfaces 166 with the receptacle block 80.

The joystick controller 20 is also provided with two selectors 175, respectively mounted on the recessed portions 35 and 36 of the base 30. Each selector 175 includes a handle 176 (FIGS. 3 and 4) disposed externally of the base 30 in the cavity formed by the recessed portion 35 or 36. The handle 176 is an elongated member which is provided at its opposite ends with two integral upstanding legs 177 which respectively extend upwardly through the apertures 37 in the recessed portion 35 or 36, the width of each of the legs 177 being substantially less than the length of the corresponding aperture 37. The upper ends of the legs 177 are interconnected by a block 178 which is disposed adjacent to the lever assembly 150 of the associated yoke 131 or 140. The legs 177 preferably are snugly fitted in the apertures 37 for frictional sliding movement back and forth therealong between a disengaged position, illustrated in FIGS. 3 and 4, out of engagement with the associated lever assembly 150, and an engaged position illustrated in FIGS. 10–13, disposed between the control blocks 155 of the levers 151 for engagement therewith.

Referring now also to FIGS. 9 through 13, the operation of the joystick controller 20 will be described. It will be appreciated that the potentiometers 160 and the switch assemblies 60 and 70 are electrically connected to an electrical cable (not shown) which extends outwardly through a complementary opening in the casing 21 to provide connection to an associated video game, computer or other apparatus. In a typical application, the joystick controller 20 will be utilized for control of a cursor display on a cathode ray tube for a video game, the direction, extent and speed of movement of the cursor corresponding to movement of the joystick handle 91. The push buttons 65 and 75 operate the switch assemblies 60 and 70 for controlling selected functions of the game. Thus, for example, these may constitute fire control switches or the like.

Initially, the handle assembly 90 is calibrated with the cursor display on the video screen. In a typical video game application, it is desirable for the most accurate control to have the center position of the handle 91 correspond as closely as possible to a cursor position exactly in the center of the video screen. For this purpose, the handle 91 is first moved to its vertical center or home position and, while it is held in this position, each of the actuators 170 is manipulated to adjust the corresponding potentiometer body 161 for moving the cursor respectively along the horizontal and vertical axes until it is in the exact center of the video screen. This adjusting movement is indicated in the first two diagrams of FIG. 9 by the different positions of the pointer on the body 161 with respect to indicia which designate different positions on the casing 21. The joystick controller 20 is now properly calibrated, and the actuators 170 will be frictionally maintained in their properly calibrated positions.

It is a significant aspect of the present invention that the joystick controller 20 is operable in two different modes, viz., a positive positioning mode and a self-centering mode. The positive positioning mode corresponds to the disengaged positions of the selectors 175 (FIGS. 5–8). As the handle 91 is moved, its component of movement along each axis effects a corresponding rotation of the associated yoke 131 or 140. When one of the yokes (e.g., the outer yoke 140) is moved, its corresponding lug 149 engages the control block 155 of one of the associated levers 151 for pivoting about the axis of rotation of the yoke 140, so that it moves with the yoke 140, pulling the other lever 151 with it by operation of the spring 157. In this mode, the levers 151 of each of the lever assemblies 150 are held in engagement with the corresponding lug 139 or 149 of the yokes 131 and 140. As each yoke moves, its lever assembly 150 moves with it. Neither lever assembly 150 moves with respect to its corresponding yoke 131 or 140, so that the springs 157 are not tensioned. Thus, when the handle 91 is moved to a predetermined position, it will remain in the position until it is again manually moved. As the yoke moves the corresponding rotor 162 is rotated to vary the impedance of the associated potentiometer 160, as is indicated in the last two diagrams in FIG. 9.

The self-centering mode of operation corresponds to the engaged positions of the selectors 175 (FIGS. 10–13). In this mode of operation, a movement of one of the yokes (e.g., the outer yoke 140) in response to a corresponding movement of the handle 91, will cause one of the associated levers 151 to move with it. The other lever 151, however, is held by the block 178 of the associated selector 175 so it cannot move. Thus, one lever 151 is pivotally moved with respect to the other, increasing the separation between the control blocks 155 and tensioning the spring 157 for resiliently urging the outer yoke 140 and the handle 91 back toward the center or home position. Had the handle 91 moved in the opposite direction, the other lever 151 would move, resulting in the same tensioning of the spring 157. The other lever assembly 150 cooperates with its selector 175 in the same manner in the self-centering mode of operation for centering the inner yoke 131.

It is a significant aspect of the present invention that when the joystick controller 20 is in its positive positioning mode of operation, the bias springs 157 are substantially untensioned. This relieves the strain and wear on the springs 157, significantly increasing their useful life.

From the foregoing, it can be seen that there has been provided an improved analog joystick controller which includes a simple and economical mechanism for providing zero adjustment of the device, and provides an improved selection mechanism for selecting between positive positioning and self-centering modes of operation while minimizing wear on the self-centering bias means.

I claim:

1. In an analog joystick controller including a housing and an operating shaft mounted in the housing for universal tilting movement with respect thereto between a neutral or home position and operating positions, the improvement comprising: bias means coupled to the operating shaft and shiftable between first and second operating conditions, said bias means in the first operating condition thereof being responsive to movement of the operating shaft from its home position for increasing the potential energy of said bias means to bias the operating shaft to its neutral or home position, said bias means in the second operating condition thereof storing minimal potential energy and being unresponsive to movement of the operating shaft for accommodating free unbiased tilting movement of the operating shaft, and actuating means for selectively disposing said bias means in either the first or the second operating condition thereof.

2. The analog joystick controller of claim 1, wherein said actuating means is manually operable.

3. The analog joystick controller of claim 1, wherein said controller includes two of said bias means each being shiftable between first and second operating conditions, said two bias means being operable for controlling movement of the operating shaft in directions respectively parallel to two perpendicular axes.

4. The analog joystick controller of claim 3, wherein said actuating means includes means for independently shifting each of said two bias means between the first and second operating conditions thereof.

5. The analog joystick controller of claim 1, wherein said bias means includes a helical tension spring.

6. The analog joystick controller of claim 1, and further including variable impedance means, said bias means coupling said variable impedance means to the operating shaft for varying the impedance of said variable impedance means in response to movement of the operating shaft, and adjusting means coupled to said variable means for adjusting the impedance thereof when the operating shaft is in a neutral or home position.

7. The analog joystick controller of claim 6, wherein said variable impedance means has an impedance portion and a wiper portion, said bias means coupling said wiper portion to the operating shaft, said adjusting means including means fixedly connected to said impedance portion for effecting movement thereof with respect to the housing.

8. In an analog joystick controller including a housing and an operating shaft mounted in the housing for universal tilting movement with respect thereto between a neutral or home position and operating positions, the improvement comprising: first and second levers each mounted for movement with the operating shaft, bias means having a normal rest condition storing minimal potential energy for resiliently coupling said levers to each other for simultaneous ganged movement in response to movement of the operating shaft, and control means selectively movable between a free condition and a homing condition, said control means in the free condition thereof being disposed out of engagement with said levers and leaving said bias means in its normal rest condition for accommodating free unbiased movement of said levers with the operating shaft, said control means in the homing condition thereof being disposed for engagement with said first and second levers for preventing movement of only one of said levers when the operating shaft moves from its home position so that only the other lever moves with the operating shaft thereby to increase the potential energy of said bias means resiliently to bias said other lever and the operating shaft back to the home position.

9. The analog joystick controller of claim 8, and further including yoke means coupled to the operating shaft for movement therewith, said first and second levers being mounted on said yoke means for pivotal movement with respect thereto.

10. The analog joystick controller of claim 8, wherein said first and second levers are mounted for pivotal movement about a first axis, and further including third and fourth levers mounted for pivotal movement with respect to a second axis perpendicular to said first axis, and second bias means resiliently coupling said third and fourth levers to each other for simultaneous ganged movement in response to movement of the operating shaft, said control means including a first portion movable between free and homing conditions with respect to said first and second levers and a second portion movable between free and homing conditions with respect to said third and fourth levers.

11. The analog joystick controller of claim 10, and further including first and second yoke means coupled to the operating shaft for movement therewith, said first and second levers being mounted on said first yoke means for pivotal movement with respect thereto, and said third and fourth levers being mounted on said second yoke means for pivotal movement with respect thereto.

12. The analog joystick controller of claim 8, wherein said bias means includes a helical tension spring.

13. The analog joystick controller of claim 8, wherein said control means comprises a retaining block movable in the homing condition thereof between said first and second levers for preventing movement of either one depending upon the direction of movement of the operating shaft.

14. The analog joystick controller of claim 8, wherein said retaining block is manually movable between the free and homing conditions thereof.

15. In an analog joystick controller including a housing, an operating shaft mounted in the housing for universal tilting movement with respect thereto between a neutral or home position and operating positions, at least one variable impedance means disposed within the housing and having an impedance portion and a wiper portion coupled to the operating shaft and movable with respect to the impedance portion in response to movement of the operating shaft, the improvement comprising: a mounting sheath carried by the housing, the impedance portion of the variable impedance means being received in said sheath and fixedly secured thereto, and adjusting means coupled to said mounting sheath and operable for effecting movement of said mounting sheath and the impedance portion of said variable impedance means with respect to the housing thereby to permit adjustment of the impedance of said variable impedance means to a value which corresponds to the neutral or home position of the operating shaft.

16. The analog joystick controller of claim 15, wherein said wiper portion is rotatably movable about a predetermined axis, said mounting sheath being adapted for rotational movement with respect to the housing about said predetermined axis.

17. The analog joystick controller of claim 15, wherein said mounting sheath includes means for limiting the movement thereof with respect to the housing.

18. The analog joystick controller of claim 15, wherein said adjusting means includes a manually operable tab slidably reciprocatively movable with respect to the housing and accessible from the outside thereof.

19. The analog joystick controller of claim 18, wherein said mounting sheath includes a slot, said adjusting means including a pin carried by said tab and receivable in said slot for effecting movement of said mounting sheath in response to movement of said tab.

20. The analog joystick controller of claim 15, and further including bias means coupled to the operating shaft and shiftable between first and second operating conditions, said bias means in the first operating condition thereof being responsive to movement of the operating shaft from its home position for increasing the potential energy of said bias means resiliently to bias the operating shaft to its neutral or home position, said bias means in the second operating condition thereof storing minimal potential energy and being unresponsive to movement of the operating shaft for accommodating free unbiased tilting movement of the operating shaft.

21. The analog joystick controller of claim 20, and further including actuating means for selectively retaining said bias means in either the first or the second operating condition thereof.

* * * * *